US011255138B2

(12) United States Patent
Gagnon et al.

(10) Patent No.: US 11,255,138 B2
(45) Date of Patent: Feb. 22, 2022

(54) CORE TUBE DISPLACER FOR LONG REACH DRILLING MACHINES

(71) Applicant: LES EQUIPEMENTS DE FORAGE VERSADRILL INC., Val-d'Or (CA)

(72) Inventors: Pierre Gagnon, Rouyn-Noranda (CA); Philippe Laplante, Trois-Rivieres (CA); Geoffrey Tenhave, St-Mathieu-d'Harricana (CA)

(73) Assignee: MBI PRODUITS DE FORAGE INC., Rouyn-Noranda (CA)

( * ) Notice: Subject to any disclaimer, the term of this patent is extended or adjusted under 35 U.S.C. 154(b) by 157 days.

(21) Appl. No.: 16/630,097

(22) PCT Filed: Jul. 10, 2018

(86) PCT No.: PCT/CA2018/050841

§ 371 (c)(1),
(2) Date: Jan. 10, 2020

(87) PCT Pub. No.: WO2019/010572

PCT Pub. Date: Jan. 17, 2019

(65) Prior Publication Data

US 2020/0157892 A1 May 21, 2020

Related U.S. Application Data

(60) Provisional application No. 62/636,990, filed on Mar. 1, 2018, provisional application No. 62/531,071, filed on Jul. 11, 2017.

(51) Int. Cl.
*E21B 19/08* (2006.01)
*E21B 19/16* (2006.01)
(Continued)

(52) U.S. Cl.
CPC ..... *E21B 19/08* (2013.01); *E21B 19/16* (2013.01); *E21B 25/005* (2013.01); *E21B 25/02* (2013.01)

(58) Field of Classification Search
CPC ..... E21B 25/005; E21B 25/02; E21B 19/08; E21B 19/16
See application file for complete search history.

(56) References Cited

U.S. PATENT DOCUMENTS 4,911,001 A * 3/1990 Ferguson ..... E21B 25/005 73/152.11
9,528,337 B2 * 12/2016 Iondov ..... E21B 25/02
(Continued)

FOREIGN PATENT DOCUMENTS

CA 2871299 A1 11/2013
WO 2010046757 A1 4/2010

*Primary Examiner* — Shane Bomar
(74) *Attorney, Agent, or Firm* — Shumaker, Loop & Kendrick, LLP; James D. Miller

(57) ABSTRACT

The long-reach drilling machine is for exploration drilling and core sample collecting and comprises a drill string comprising a variable number of hollow drill rods, a drill bit installed at a first end of the drill string, a ground-resting drill base for installation outside a borehole, a mast attached to the drill base, a drill head installed on and movable along the mast and to which a second end of the drill string is connected, the drill head rotating the drill string, a core tube movable within the drill string between a first position at the drill string first end for receiving a core sample and a second position at the drill string second end, an borehole core tube displacer capable of displacing the core tube between its first and second positions, and an external core tube displacer, distinct from the borehole core tube displacer, comprising a frame that is fixed relative to the drill string, a tube prehension device mounted to the frame and capable of traction on the core tube, and an actuator mounted to the frame and
(Continued)

selectively actionable to activate the tube prehension device for allowing the core tube to be displaced relative to the frame beyond its second position.

18 Claims, 9 Drawing Sheets

(51) Int. Cl.
*E21B 25/00* (2006.01)
*E21B 25/02* (2006.01)

(56) References Cited

U.S. PATENT DOCUMENTS

| | | | | |
|---|---|---|---|---|
| 9,909,377 | B2 * | 3/2018 | Finkenzeller | E21B 25/18 |
| 2009/0178847 | A1 * | 7/2009 | Nellessen, Jr. | E21B 25/18<br>175/5 |
| 2011/0079436 | A1 * | 4/2011 | Drenth | E21B 25/02<br>175/58 |
| 2015/0368993 | A1 * | 12/2015 | Fournier | E21B 25/08<br>175/52 |
| 2017/0152719 | A1 * | 6/2017 | Finkenzeller | E21B 19/143 |
| 2017/0259633 | A1 * | 9/2017 | Olmedo | B60F 3/0023 |
| 2019/0338610 | A1 * | 11/2019 | Shan | E21B 25/005 |
| 2021/0032947 | A1 * | 2/2021 | Montoya | G01N 33/24 |

* cited by examiner

CORE TUBE DISPLACER FOR LONG REACH DRILLING MACHINES

FIELD OF THE INVENTION

The present invention relates to ground drilling operations, and more particularly to a core tube displacer for retrieving a core tube from, and inserting a core tube into, the drill string of a long reach drilling machine used in exploration drilling.

BACKGROUND OF THE INVENTION

Long-reach drilling machines are used in the mining industry to explore the ground for specific mineral formations. This exploration is accomplished by drilling very long boreholes that can be up to about 5000 meters long (about 16 250 feet long) to extract in-depth core mineral samples from the ground. The mineral composition of these mineral samples can then be studied and evaluated to determine if mining operations will take place where the mineral sample was retrieved. This type of exploration drilling is also called core drilling.

To drill the borehole, a hollow drill string composed of end-to-end drill rods is put into rotation by means of a drill head. At one end of the drill string is located the core bit, a ring-shaped bit that is typically composed of a metal matrix to which is added tungsten or tungsten carbide powder and which is impregnated with diamonds fragments, to obtain the necessary hardness to cut through the rock. The core bit is also often called the diamond drill bit. The drill bit cuts the core sample out of the rock by rotating at high speed and with a certain amount of pressure being forced on the ground. This core bit is attached to a reaming shell that reams the hole to the desired diameter size. The reaming shell may also be impregnated with diamonds or tungsten carbide. The reaming shell also helps to stabilize the core bit drilling process.

The reaming shell is attached to the wireline core barrel, the part of the equipment that will collect the core sample. A wireline core barrel includes two components: an inner tube assembly and an outer tube assembly. While the outer tube assembly rotates with the drill rods, the inner tube assembly does not rotate. The inner tube assembly includes a core tube which is the piece that will actually hold the core sample during the drilling process. The core tube has at its first end a core case assembly, through which the core sample is received and that allows it to be retained within the core tube; and its second end a head assembly that closes the core tube second end.

As mentioned above, the wireline core barrel is connected to the drill head by drill rods. The deeper the bore hole, the more drill rods are needed. Drill rods transfer the torque, feed, force and rotation speed required to drill into the rock, from the drill head to the drill bit. A drill's pressure pump is used to pump drilling fluids in to the drill string. The fluids will flush the rock cuttings away from the bit and carry them to the surface and will cool the bit at the same time.

Core samples are retrieved from the core barrel as drill rods are added to drill deeper into the ground. The core samples are extracted within the above-mentioned core tube. To accomplish this, the core tube is first conveyed while the drill string does not rotate through the drill string all the way down the bore hole, with gravity in the case of a downhole, or with water that is pumped inside the hallow drill rods to push the core tube in the case of an uphole or an insufficiently downwardly inclined hole, until the core tube locks into the core barrel. As the drill string rotates to drill the ground, the core barrel will slide over the core sample as it is cut and the core sample will fill the core tube. When the core tube is full, the drilling is interrupted. An overshot attached to the end of a winch cable is inserted inside the drill string, conveyed by gravity or pushed by water, and locks onto the head assembly, or backend, that is attached to the core tube. The winch is retracted, pulling the core tube to the surface. The core sample does not drop out from inside the core tube due to the above-mentioned core case assembly and head assembly that plug both extremities of the core tube.

The core tube is pulled out through the drill string with the winch cable, until it reaches a retrieval positon where one of its extremities slightly protrudes through the drill string. The overshot is removed from the head assembly, and the head assembly is removed from the inner tube. The core tube is then manually grasped and pulled out of the drill head. The core sample is removed from the core tube and catalogued. In some applications, the core tube is pulled out of the drill string entirely before the head assembly and/or the overshot are removed, but the method remains otherwise equivalent.

The manual removal of the inner core tube (possibly with the head assembly and/or overshot attached) from the drill head is a tedious manoeuver since the core tube is heavy even when empty, and even more so when it is filled with a core sample. This manipulation of the core tube is difficult due to the weight alone, but it is further made difficult due to the length of the tube: some core tubes are indeed formed of a few tube segments that are screwed to each other, totaling for example 15 meters long, making the removal of the core tube cumbersome and difficult due to its length and weight. In fact, due to the difficulty in manoeuvrability and handling, and to the limited space in mines, core tubes of lesser length are often used.

The winch cannot pull the core tube completely out of the drill string itself for the following reasons. Firstly, the length of the coextensive core tube, head assembly and overshot that are installed in end to end relationship is important. Indeed, the core tube itself can have for example between 5 and 15 meters long; while the head assembly and overshot add a few meters to that length. These elements extend away from the drill string when the core tube reaches its retrieval position, which prevents the winch from further pulling on the core tube in underground mining operations because there is no space for the coextensive overshot, head assembly and overshot to extend beyond the drill string. Indeed, the winch simply cannot allow displacement of the core tube beyond its retrieval position. Consequently the overshot and head assembly need to be removed as soon as the core tube reaches its retrieval position with one end barely protruding out of the drill head; and then the core tube needs to be manually pulled out of the drill string and drill head.

In some outdoor mining operations, where downholes are made, there would be space for the coextensive core tube, head assembly and overshot to extend upwardly out of the drill head, however for the winch to be used to pull on the core tube, this would require the winch cable to be positioned high enough to pull these three elements. Since the winch cable is usually attached to the overshot through a pulley, the mast holding the pulley would need to be very long to allow this, and such length is simply not manageable on a drilling machine. Furthermore, a mast of that length would have to be carried to the mining site, and with most mining sites being remote, the transportation of such a long component is not desirable.

SUMMARY OF THE INVENTION

The invention relates to a long-reach drilling machine for exploration drilling and core sample collecting, comprising:

a drill string comprising a variable number of hollow drill rods and defining opposite first and second ends;

a drill bit installed at the first end of the drill string for cutting a bore hole through the ground and for cutting core samples out of the ground;

a ground-resting drill base for installation outside the borehole;

a mast attached to the drill base;

a drill head installed on and movable along the mast and to which the second end of the drill string is connected, the drill head rotating the drill string;

a core tube movable within the drill string between a first position at the drill string first end for receiving a core sample and a second position at the drill string second end;

an borehole core tube displacer capable of displacing the core tube between its first to its second positions only; and an external core tube displacer, distinct from the borehole core tube displacer, comprising a frame that is fixed relative to the drill string, a tube prehension device mounted to the frame and capable of traction on the core tube, and an actuator mounted to the frame and selectively actionable to activate the tube prehension device for allowing the core tube to be displaced relative to the frame beyond its second position.

In one embodiment, the tube prehension device and the actuator allow movement of the core tube in two different directions relative to the drill string for retrieving the core tube from the drill string when it is located at its second position, and for inserting the core tube into the drill string to position it at its second position.

In one embodiment, the prehension device includes rollers defining a tube channel therebetween that the core tube will engage, with the actuator acting on at least some of the rollers to rotate them.

In one embodiment, the rollers have outer surfaces provided with diamond fragments for providing a high friction coefficient between the outer surfaces and the core tube.

In one embodiment, the rollers are coated with a friction layer comprising the diamond fragments.

In one embodiment, at least some rollers are movable with respect to each other between an engaged position in which the at least some rollers are displaced towards the tube channel to grasp the core tube and allow its retrieval from and insertion into the drill head, and a disengaged position in which the at least some rollers are displaced away from the tube channel to release the core tube.

In one embodiment, the frame is attached to the drill head.

In an alternate embodiment, the frame is pivotally attached to one of the drill head, the drill base and the mast such that it is pivotable between an operative position in which it is pivoted towards a path of the core tube incoming or outgoing with respect to the drill string such that the core tube can engage the tube channel, and an inoperative position in which it is pivoted away from the path of the core tube incoming our outgoing with respect to the drill string such that the core tube cannot engage the tube channel.

In one embodiment, the borehole core tube displacer comprises at least one of a winch and a water pump.

The invention also relates to a method of displacing a core tube with respect to a drill string of a long reach drilling machine as defined above, comprising:

engaging the core tube with the tube prehension device of the external core tube displacer; and activating the prehension device of the external core tube displacer with the actuator to displace the core tube with respect to the drill string beyond its second positon.

The invention also relates to an external core tube displacer for use with a long-reach drilling machine for exploration drilling and core sample collecting of the type comprising a drill string having a first end equipped with a drill bit and a second end opposite the first end, and a core tube movable within the drill string between the first and second ends only with an borehole core tube displacer, the external core tube displacer comprising a frame for fixed attachment relative to the drill string, a tube prehension device mounted to the frame and capable of traction on the core tube, and an actuator mounted to the frame and selectively actionable to activate the tube prehension device for allowing the core tube to be displaced relative to the frame and relative to the drill string beyond the second end.

DETAILED DESCRIPTION OF THE EMBODIMENTS

Figure 1A:
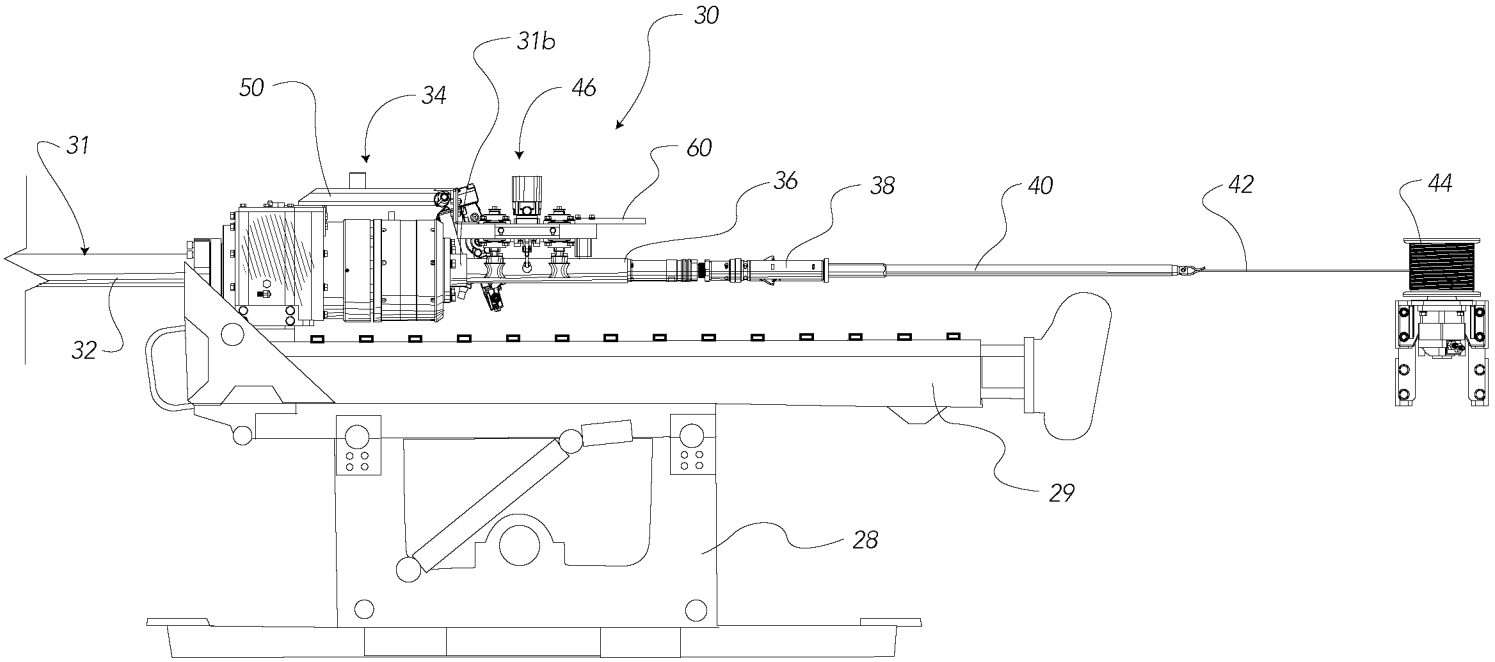
FIG. 1*a* is a side elevation of a long-reach drilling machine comprising an external core tube displacer according to the present invention, with only the portion of the drill string near its second end being shown.
Figure 1B:
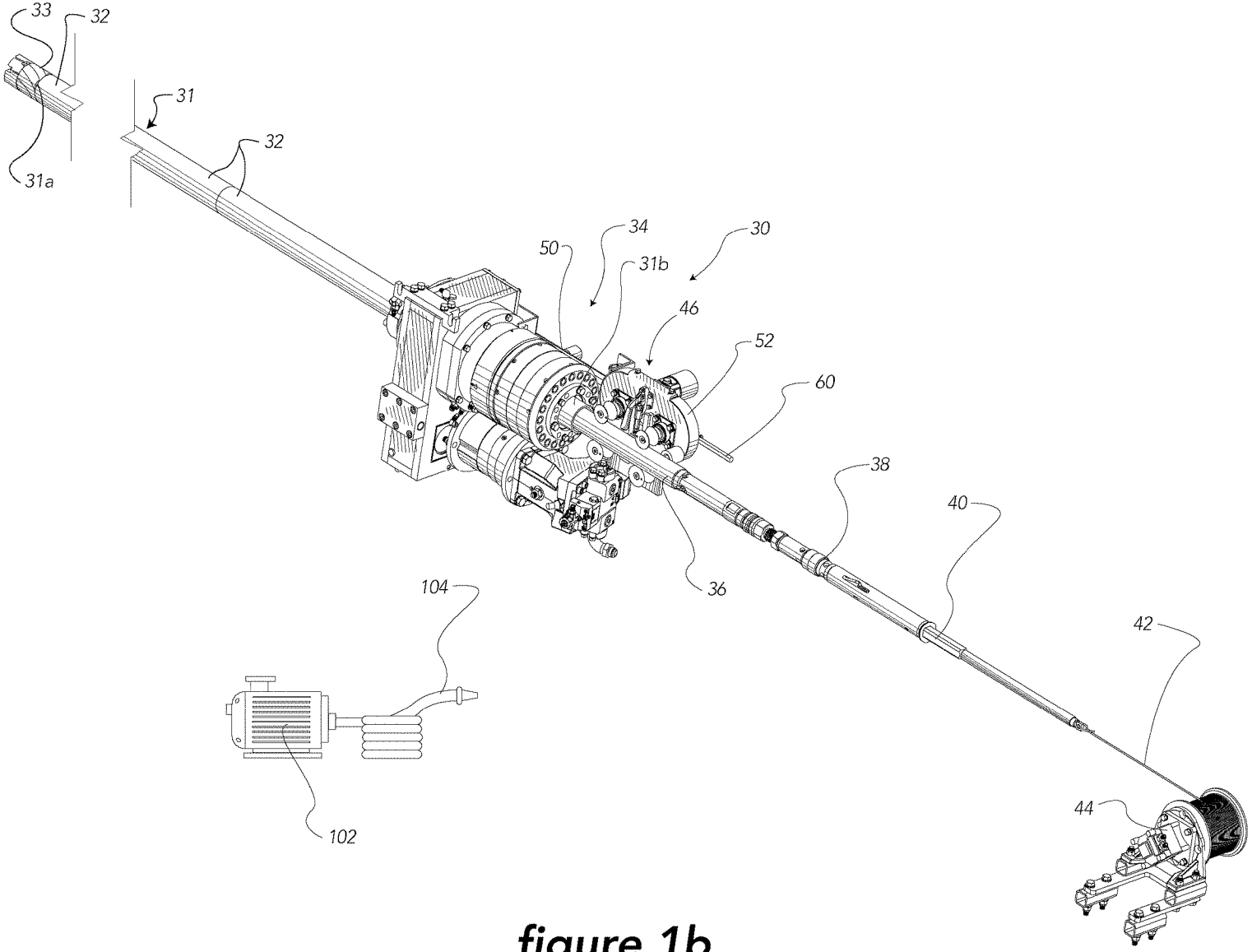
FIG. 1*b* is a bottom perspective view of the long-reach drilling machine of FIG. 1*a*, with the drill base and mast being removed and with the drill string being shown complete, albeit broken to suggest its variable length, to additionally show its first end; and with a pump used to convey the core tube and overshot in the drill string further being shown.

FIGS. 1*a* and 1*b* show a long-reach drilling machine 30 for exploration drilling and core sample collecting, comprising a drill string 31 that comprises a variable number of end-to-end hollow drill rods 32. A drill bit 33 is installed at a first end 31*a* of the drill string 31 for cutting a borehole through the ground and for cutting core samples out of the ground, as known in the art.

Drilling machine 30 also comprises a ground-resting drill base 28 for installation outside the borehole (not shown), a mast 29 attached to the drill base 28 and a drill head 34 installed on and movable along mast 29 by means of a powered hydraulic cylinder (concealed in FIG. 1*a*) conventionally equipped on mast 29. Drill string 31 extends through drill head 34 such that a second end 31*b* of the drill string 31, opposite the first end 31*a*, protrudes beyond drill head 34. Drill string 31 is operatively connected to the drill head 34 near its second end 31*b* in a known manner such that the drill head 34 can rotate the drill string 31. With the drill head 34 being longitudinally movable along the mast 29 as known in the art, drill rods 32 can be gradually added one by one to drill string 31 to gradually force drill string 31 into the ground. Drill string 31 increases in length as the borehole becomes deeper and deeper, such that the drill string 31 can reach several thousand meters of length.

Drilling machine 30 also comprises a core tube 36 that is movable through the drill head 34 and within the drill string 31 as detailed hereinafter. The core tube 36, as is known in the art, is equipped at one end with a core case assembly 37 (FIG. 12) that allows the core sample into the inner tube 36 but prevents it from egress; and at its other end is equipped with a head assembly 38 that is screwed to core tube 36. Core tube 36 can be pushed through drill string 31 from its second end 31*b* towards its first end 31*a* by gravity in the case of a downhole, or in the case of an uphole or a hole that has an insufficient downward inclination to allow gravity alone to work, by water being pumped in drill string 31 with a pump 102 that is connectable to the second end 31*b* of drill string 31 with a tube 104. Core tube 36 will be thusly conveyed within drill string 31 and within the borehole until it reaches the drill string first end 31*a* where a core sample will be recuperated within core tube 36. After the drilling operation is interrupted, core tube 36 can be pulled out of drill string 31 by conveying an overshot 40 within drill string 31 again with gravity or with water being pumped with pump 102, until overshot 40 reaches and latches onto head assembly 38. Overshot 40 is attached to a winch cable 42 that unwinds as overshot 40 travels within drill string 31 towards first end 31*a*, and a winch 44 is actuated to pull core tube 36 with winch cable 42 towards and up to the drill string second end 31*b* once overshot 40 has latched onto core tube 36. Pump 102, pump tube 104, winch 44, winch cable 42 and overshot 40, represent a borehole core tube displacer that allows core tube 36 to be moved in the borehole, and more precisely within drill string 31 between a first position at drill string first end 31*a* and a second position at drill string second end 31*b*. At its second position, core tube 31*b* will protrude from drill string 31*b* without however winch 44 being capable of further pulling on core tube 31*b* due to the length of the combined core tube 36, head assembly and overshot 40, and the limited space available in mines and on mast 29.

According to the invention, drilling machine 30 further comprises an external core tube displacer 46 that is used to move core tube 36 beyond its second position, out of drill string second end 31*b*, to retrieve core tube 36 from within the drill string 31, instead of having to manually retrieve it as has been done in prior art methods.

Figure 2:
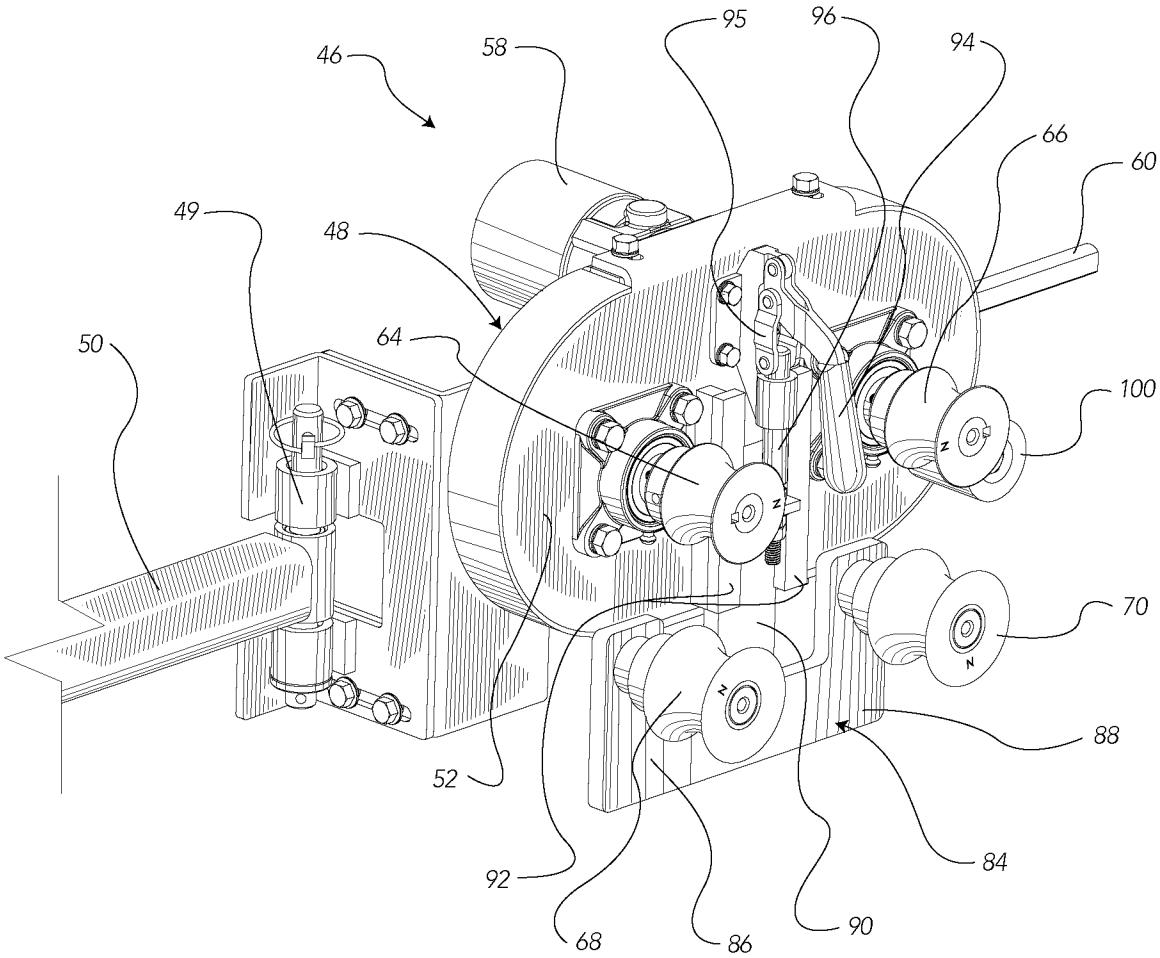
FIG. 2 is an enlarged perspective view of the external core tube displacer of FIG. 1*b;*
Figure 3:
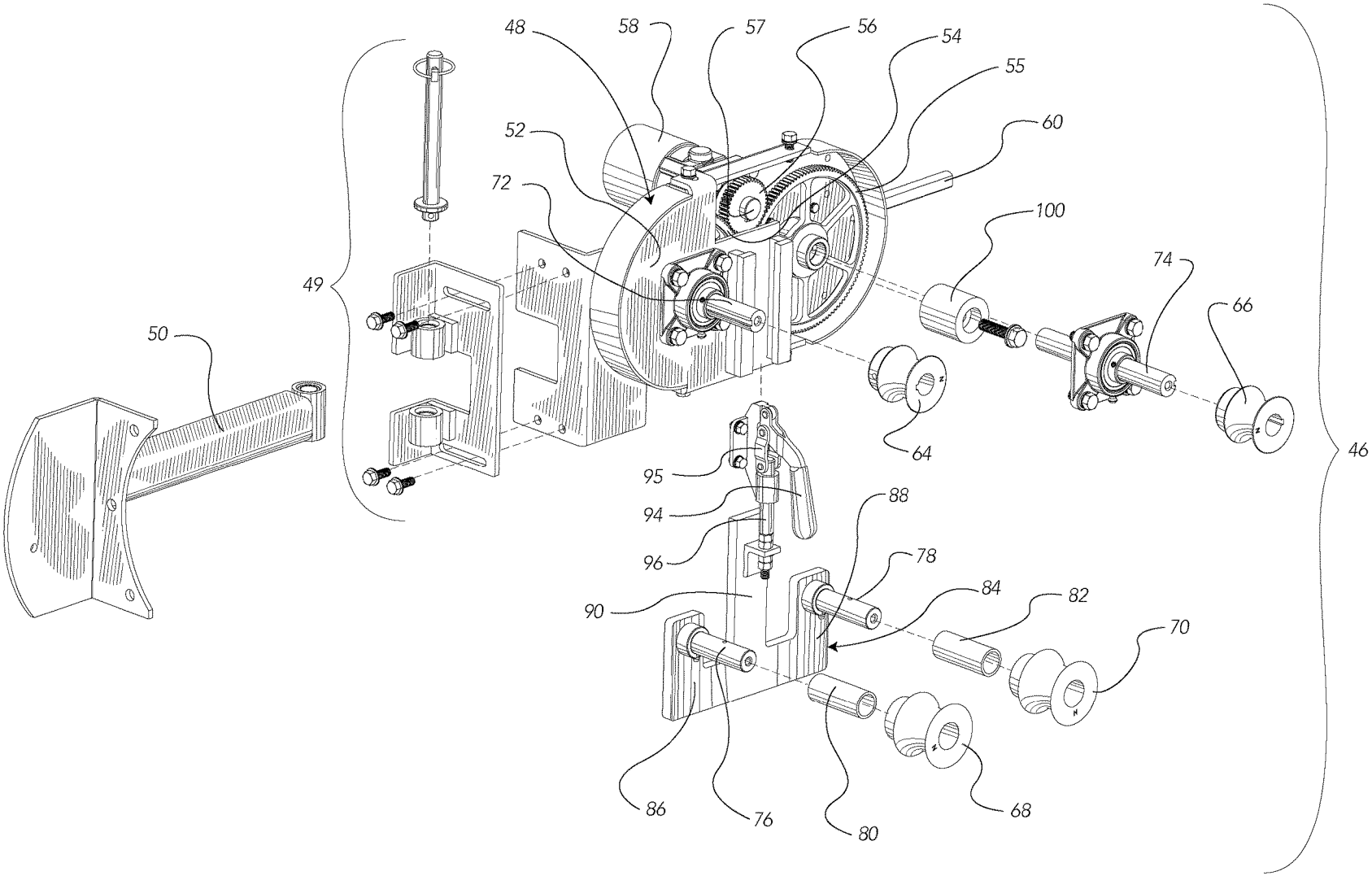
FIG. 3 is similar to FIG. 2, but with the external core tube displacer being partly exploded and partly fragmented.

External core tube displacer 46, shown in FIGS. 1-3, comprises a frame 48 that is pivotally attached with a lockable hinge 49 to a bracket 50 that is in turn fixedly attached to the drill head 34. Hinge 49 also allows casing 52 some leeway for limited movement longitudinally along the pivotal axis of hinge 49, as detailed hereinafter.

Frame 48 includes a casing 52 that encloses a pair of driving gear wheels 54, 55 that are operatively connected to a motor gear wheel 56 that is in turn installed on the shaft 57 of a motor 58 carried by casing 52, with shaft 57 extending through casing 52. A motor lever 60 allows motor 58 to be activated to rotate shaft 57 in either direction, which results in driving gear wheels 54, 55 both being rotated in a corresponding selected direction.

External core tube displacer 46 also comprises a tube prehension device 62 mounted to frame 48. More particularly, tube prehension device 62 comprises a set of rollers 64, 66, 68, 70 fixedly mounted to respective shafts 72, 74, 76, 78. Two rollers 64, 66 are driving rollers and they are fixedly attached to their shafts 72, 74. Shafts 72, 74 extend through casing 52 and that are coaxially fixedly attached to respective driving gear wheels 54, 55 to rotate therewith. The other two rollers 68, 70 are idle rollers and they are rotably installed by means of low-friction sleeves 80, 82 on their shafts 76, 78. Shafts 76, 78 are fixed to a sliding plate 84. Sliding plate 84 is part of frame 48 and comprises pair of lateral legs 86, 88 each carrying one of shafts 76, 78; and a central leg 90 that engages and is slidable within a track 92 fixedly mounted to casing 52. A lockable roller lever 94 pivotally attached to casing 52, is connected by a linkage 95 to a pin 96 that is itself attached to sliding plate 90. Consequently, manually pivoting roller lever 94 controls the translation of sliding plate 90 relative to casing 52. Roller lever 94 can lock in either position where idle rollers 68, 70 are nearer or further from driving rollers 64, 66.

Motor 58 and gear wheels 54, 55, 56 consequently form an actuator capable of activating driving rollers 64, 66 to rotate in either direction.

A cylindrical bumper 100 is installed on casing 52.

In use, as noted above core tube 36 is movable between its first position at the drill string first end 31*a* for recuperating a core sample and its second position at the drill string second end 31*b* where it will protrude at least slightly through drill string second end 31*b*. Gravity, or water pump 102, can be used to move core tube 36 from its second position to its first position. Winch 44 and cable 42 are used to pull core tube 36 from its first position to its second position, while external core tube displacer 46 can move core tube 36 beyond its second position 31*b* to extract it from drill string 31, as explained hereinafter.

Figure 4:
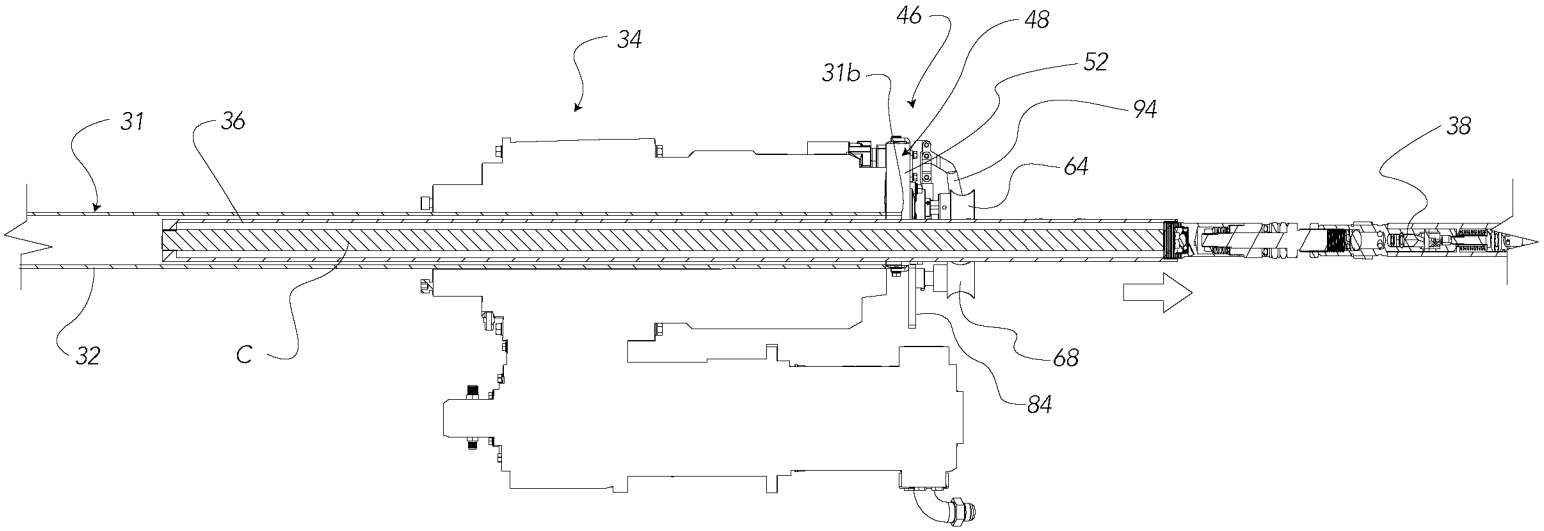
FIG. 4 is a cross-sectional elevation of the drill head (shown schematically), the external core tube displacer and the portion of the drill string near its second end of FIG. 1*b*, with the external core tube displacer being pivoted in its inoperative position, further showing the core tube as it extends through the drill head together with the head assembly and part of the overshot.

Core tube 36 is to be extracted from drill string 31 after it is first moved to its second position at drill string second 31*b*, where it will protrude at least slightly beyond core tube second end 31*b* as shown in FIG. 4. Winch 44 is conventionally used to pull on core tube 36 to have it reach its second position.

At this point, winch 44 is stopped from rotating and core tube 36 is immobilized. In prior art methods where an external core tube displacer 46 was not available, the miner would be forced to manually pull the core tube 36 loaded with a core sample C (FIG. 4) beyond its second position out of the drill string 31 and through drill head 34. With the present invention however, the extraction of core tube displacer 46 is used to accomplish this task instead.

Figure 5:
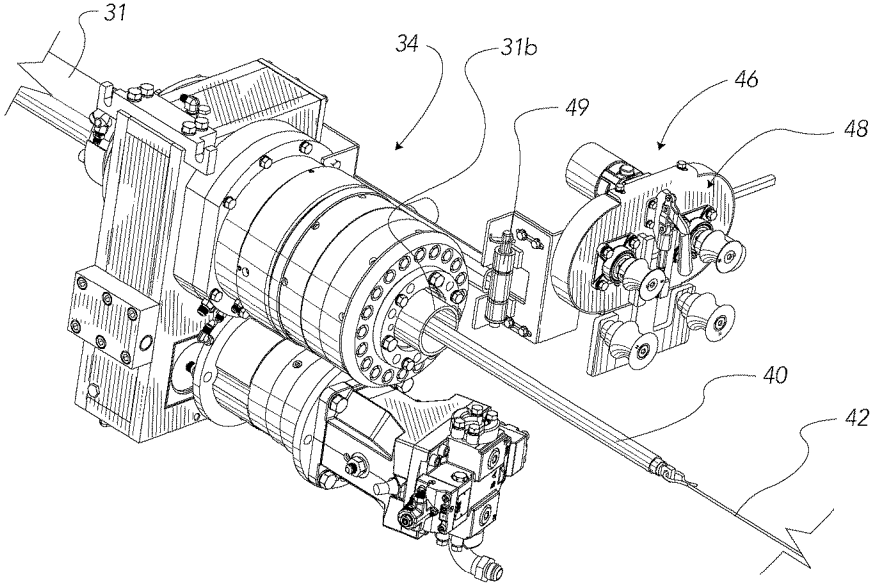
FIGS. 5 and 6 are perspective views of the drill head, the external core tube displacer and the portion of the drill string near its second end of FIG. 1*b*, further showing the external core tube displacer and the head assembly as they protrude out of the drill string, sequentially showing the pivotal displacement of the external core tube displacer frame from its inoperative to its operative position.
Figure 6:
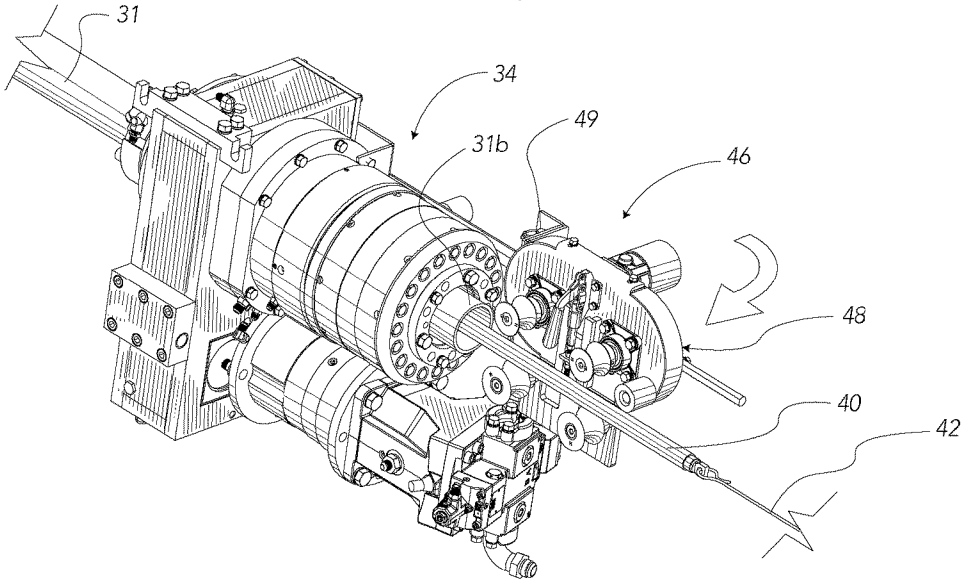

Frame 48 is pivotable relative to drill head 34 about hinge 49 between an operative position shown in FIG. 6 in which it is pivoted towards a path of the core tube incoming or outgoing with respect to the drill head 34 and an inoperative position shown in FIG. 5 in which it is pivoted away from the path of the core tube 36 incoming our outgoing with respect to the drill head 34. Consequently, while core tube 36 is travelling within drill string 31 and external core tube displacer 46 is not required, frame 48 can be pivoted in its inoperative position as shown in FIG. 5 to be out of the way. When core tube 36 reaches its second position at the drill string second end 31*b*, and once winch 44 is stopped from pulling on core tube 36, frame 48 is pivoted into it operative position as shown in FIG. 6. As will be understood, the precise timing of the pivoting of frame 48 in its operative position is not crucial, as long as it done soon enough to allow the retrieval of core tube 36 as detailed hereinafter.

Rollers are spaced from core tube 36 when frame 48 is pivoted in its operative position. This allows the grooved rollers 64, 66, 68, 70 not to interfere with this pivotal displacement.

Figure 7:
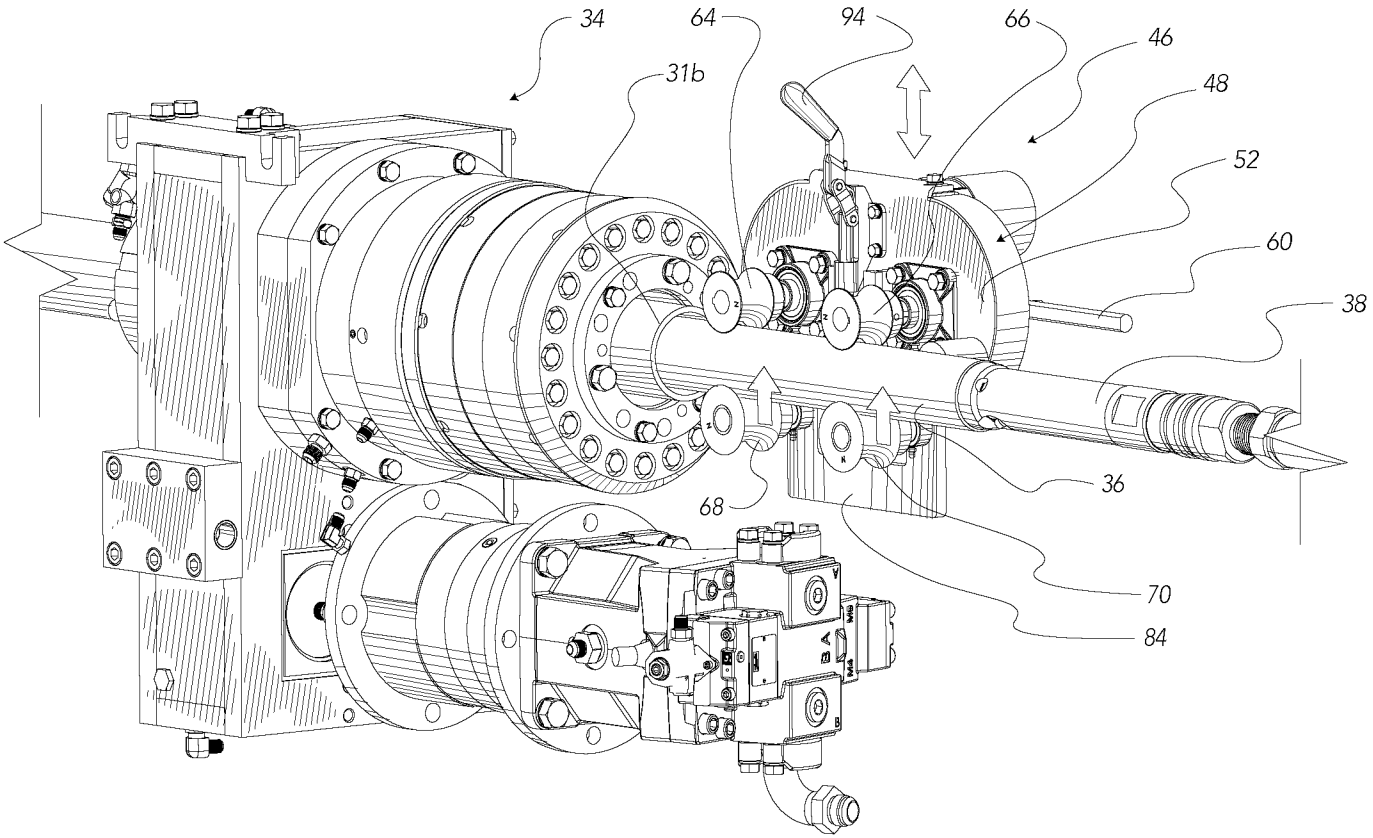
FIG. 7 is an enlarged perspective views of the drilling machine of FIG. 6, showing the displacement of the rollers from their disengaged to their engaged position.

As sequentially shown in FIGS. 6 and 7, roller lever 94 is then raised to move idle rollers 68, 70 and driving rollers 64, 66 towards each other. More particularly, by raising roller level 84, sliding plate 84, and consequently idle rollers 68, 70, are forced towards driving rollers 64, 66. As idle rollers 68, 70 move towards driving rollers 64, 66, they will abut against core tube 36 and hinge 49—that allows some leeway for casing 52 to move longitudinally along the axis of hinge 49 as mentioned above, will then also concurrently allow casing 52 to move towards idle rollers 68, 70 as suggested in FIG. 7. Idle rollers 68, 70 are consequently movable relative to driving rollers 64, 66 between an engaged position in which idle rollers 68, 70 and driving rollers 64, 66 are displaced towards each other and rollers 64, 66, 68, 70 engage and grasp the outer surface of core tube 36 such that a tube channel is defined between rollers 64, 66, 68, 70 wherein core tube 36 extends; and a disengaged position in which idle rollers 68, 70 and driving rollers 64, 66 are displaced away from each other and away from the tube channel to release core tube 36. So when roller lever 94 is raised, rollers 64, 66, 68, 70 will in fact be moved towards the tube channel to engage core tube 36 and also to force core tube 36 against driving rollers 64, 66, so that core tube 36 will effectively be grasped between rollers 64, 66, 68, 70 and be movable by friction engagement with driving rollers 64, 66.

Bumper 100 helps align core tube 36 with respect to rollers 64, 66, 68, 70 and avoid that core tube 36 accidentally comes into contact with casing 52, which might damage it.

Figure 8:
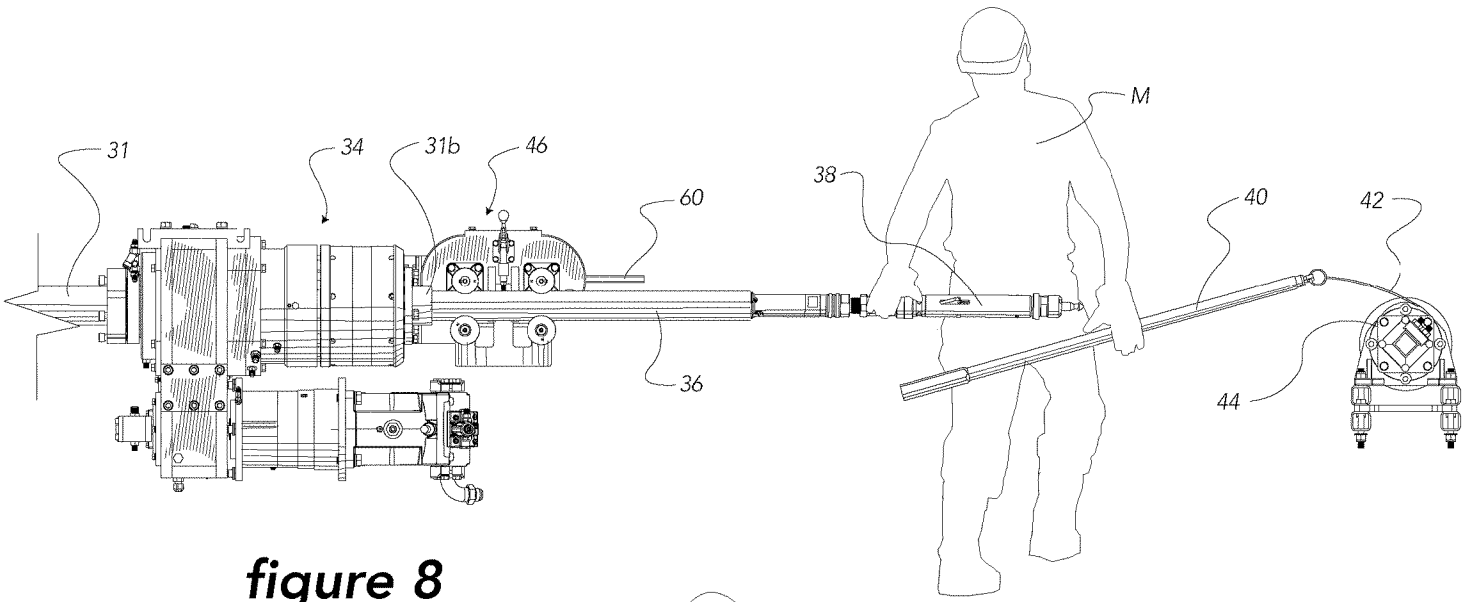
FIGS. 8-11 are perspective views of the drill head, the external core tube displacer, the portion of the drill string near its second end, the head assembly (FIGS. 9 and 10 only), the overshot (FIG. 9 only), and the winch and winch cable (FIG. 9 only), sequentially showing the removal by a miner of the overshot (FIG. 9), of the head assembly (FIG. 10), and of the core tube (FIGS. 11 and 12), in the latter case helped by the external core tube displacer.
Figure 9:
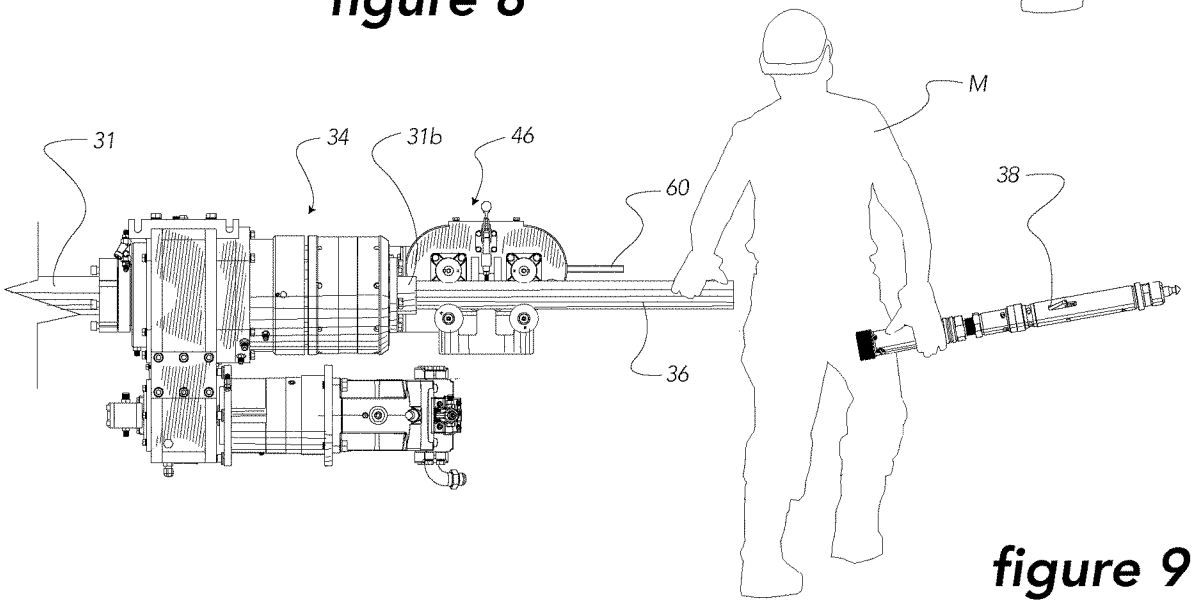

As shown in FIGS. 8 and 9, a miner M can then remove overshot 40 from head assembly 38, and head assembly 38 from core tube 36, with the appropriate tools.

Figure 10:
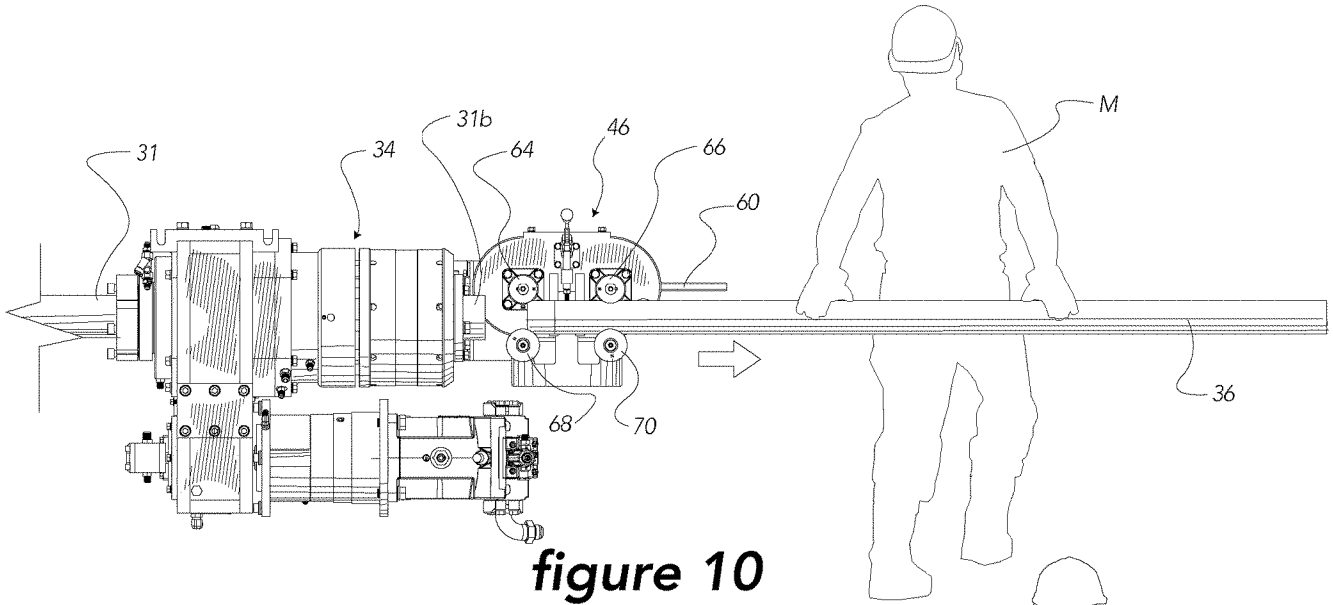
Figure 11:
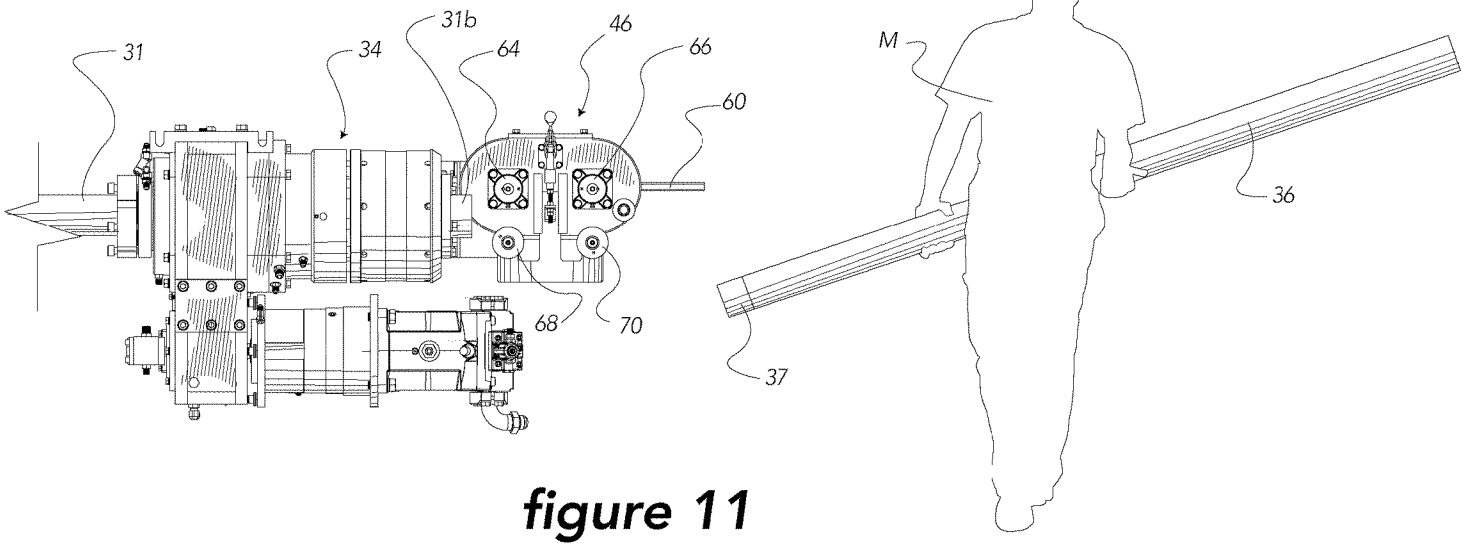

Motor lever 60 is then controlled by the miner M to activate the external core tube displacer motor 58, to rotate driving rollers 64, 66 that will force core tube 36 gradually out of drill string 31, beyond the second position of core tube 36 at the drill string second end 31*b*, through and out of drill string 31 as shown in FIG. 10, and finally out of external core tube displacer 46 allowing core tube 36 to be carried away by miner M as shown in FIG. 11. Motor lever 60 can be controlled to stop motor 58 and roller lever 94 can be lowered to move rollers 64, 66, 68, 70 in their disengaged position in expectation of rollers 64, 66, 68, 70 being used later.

In some applications, the core tube 36 is pulled out of the drill string entirely before the head assembly 38 and/or the overshot 40 are removed, but the method remains otherwise equivalent.

It will be understood that sufficient friction must be obtained between the set of driving rollers 64, 66 and the set of idle rollers 68, 70, on one hand, and core tube 36 on the other hand; when core tube 36 is grasped on either side by rollers 64, 66, 68, 70. To achieve this desired friction, an appropriate combination of a surface with a high enough friction coefficient on rollers 64, 66, 68, 70 and pressure exerted by rollers 64, 66, 68, 70 on core tube 36 is necessary.

In one embodiment, rollers 64, 66, 68, 70 have outer surfaces provided with diamond fragments for providing a high friction coefficient between the outer surfaces and the core tube. This can be achieved either by having rollers 64, 66, 68, 70 themselves impregnated with diamonds, or by having rollers 64, 66, 68, 70 coated with a friction layer comprising diamond fragments.

One advantage of having a surface with a particularly high friction coefficient is that it allows a lower pressure to be applied by rollers 64, 66, 68, 70 on core tube 36. A lower pressure is desirable to avoid the core tube being damaged by the rollers. Indeed, although core tubes are usually made of steel, they have a relatively thin wall to reduce their weight and facilitate their handling by miners, and their travelling through the drill string 31 both to convey them to the drill string first end 31*a* with water, and to retrieve them with winch 44. But, once they are loaded with a core sample, the total weight is significant.

To avoid the rollers sliding on the core tube 36 thus requires a suitable balance between sufficient pressure applied by rollers 64, 66, 68, 70 and a good friction coefficient between rollers 64, 66, 68, 70 and core tube 36, where a higher friction coefficient is advantageous to avoid higher pressure on core tube 36.

Although the core tube is easier to manipulate once it is emptied of its core sample, external core tube displacer 46 can also be used to move core tube 36 beyond its second position but in the opposite direction to insert it into drill string 31, at its second position at drill string second end 31*b*, when a new core sample is to be obtained. The steps will be similar, although inverted, to those described above: the core tube extremity equipped with core case assembly 37 is inserted between rollers 64, 66, 68, 70; roller lever 94 is raised to have rollers 64, 66, 68, 70 grasp core tube 36; motor lever 60 is controlled to activate driving rollers 64, 66 in the opposite direction as that previously used to extract core tube 36, to have core tube 36 be forced towards and into drill string 31, until it reaches its second positon at drill string second end 31*b* with only an extremity of core tube 36 protruding from drill string 31, at which point rollers 64, 66, 68, 70 are stopped from rotating by shutting off motor 58; head assembly 38 is installed on core tube 36; and core tube 36 is finally conveyed into drill string 31 towards its first end 31*a* using gravity or a borehole core tube displacer such as water pump 102, as known in the art.

It can be understood from the above that the borehole core tube displacer, which can include only winch 44/cable 42/overshot 40 in downholes, but which may optionally include water pump 102 in upholes or in holes with an insufficient downward inclination for gravity to work alone, conventionally allows the displacing of core tube 36 within drill string 31 between its first and second ends 31*a* and 31*b* only. It is further understood that the borehole core tube displacer does not allow the displacement of core tube 36 beyond its second positon: the water pump only works when core tube is entirely within drill string 31, including the core tube's head assembly 38; while the winch 44, cable 42 and overshot 40, that work cooperatively with the core tube's head assembly, require space that is simply usually not present in mining operations. The external core tube displacer 46 of the present invention, that is distinct from the borehole core tube displacer, allows the core tube 36 to be displaced beyond its second position at the drill string second end 31*b*, i.e. when the winch 44 is not usable anymore for extraction, and before the water pump 102 is usable for insertion.

This notably allows much longer core tubes to be used, for example at lengths of 15 meters (50 feet) as opposed to 5 meters (17 feet) only, since the extraction of the core tube loaded with minerals becomes feasible without winch 44. The use of longer core tubes reduces the number of times the core tube needs to be inserted into and retrieved from the drill string 31 for sampling a same depth of ground. This results in a net advantage, as recuperating an equal quantity of core samples requires less operations and less time, which saves a considerable amount of money in the core sampling operations.

It is noted that although motor 58 is described herein as acting on two driving rollers 64, 66, it could in an alternate embodiment act on any number, including a single one or all, of the rollers 64, 66, 68, 70. Generally, any prehension device capable of traction on the core tube can be used, and any actuator that is selectively actionable to activate the tube prehension device for allowing the tube to be displaced relative to the frame and relative to the drill head would be appropriate; although the rollers are considered to be an advantageous embodiment.

It has been described above that the tube prehension device (e.g. rollers 64, 66, 68, 70) and the actuator (e.g. motor 58 and gear wheels 54, 55, 56) allow movement of the core tube 36 in two different directions relative to the frame 48 and drill head 34 for retrieving the core tube 36 from the drill string 31, and for inserting the core tube 36 into the drill string 34; but in an alternate embodiment the tube prehension device could be used to only retrieve or only insert the core tube 36 within the drill string 31.

In another alternate embodiment, the frame 48 could be fixedly attached to the drill head without a hinge.

In another embodiment, the frame 48 could be fixed to another structure than drill head 34, such as to drill base 28, mast 29 or a distinct support such as a tripod (not shown), in all cases in such a way that its position is fixed relative to drill string 31 during use. Particularly, in some applications (not shown), as known in the art, the drill head 34 might be moved away from the drill string second end 31*b* when core tube 36 is to be retrieved from and inserted into the drill string 31. The external core tube displacer 46 of the present invention obviously works as well in such applications, but would then be fixed as suggested above to another structure than drill head 34.

The invention generally concerns a method of displacing core tube 36 beyond its second position at drill string second end 31*b*, in the context of a long reach drilling machine, that comprises engaging the core tube 36 with the tube prehension device 62 of the external core tube displacer 46; and activating the prehension device 62 of the external core tube displacer 46 with the actuator to displace the core tube 36 with respect to the frame 52 and to the drill string 31.

The invention claimed is:

1. A long-reach drilling machine for exploration drilling and core sample collecting, comprising:

a drill string comprising a variable number of hollow drill rods and defining opposite first and second ends;

a drill bit installed at the first end of the drill string for cutting a bore hole through the ground and for cutting core samples out of the ground;

a ground-resting drill base for installation outside the borehole;

a mast attached to the drill base;

a drill head installed on and movable along the mast and to which the second end of the drill string is connected, the drill head rotating the drill string;

a core tube movable within the drill string between a first position at the drill string first end for receiving a core sample and a second position at the drill string second end;

an borehole core tube displacer capable of displacing the core tube between its first and second positions only; and an external core tube displacer, distinct from the borehole core tube displacer, comprising a frame that is fixed relative to the drill string, a tube prehension device mounted to the frame and capable of traction on the core tube, and an actuator mounted to the frame and selectively actionable to activate the tube prehension device allowing the core tube to be displaced relative to the frame beyond its second position.

2. The long-reach drilling machine as defined in claim 1, wherein the tube prehension device and the actuator allow movement of the core tube in two different directions relative to the drill string for respectively retrieving the core tube from the drill string when it is located at its second position, and for inserting the core tube into the drill string to position it at its second position.

3. The long-reach drilling machine as defined in claim 2, wherein the prehension device includes rollers defining a tube channel therebetween that the core tube will engage, with the actuator acting on at least some of the rollers to rotate them.

4. The long-reach drilling machine as defined in claim 3, wherein the rollers have outer surfaces provided with diamond fragments for providing a high friction coefficient between the outer surfaces and the core tube.

5. The long-reach drilling machine as defined in claim 4, wherein the rollers are coated with a friction layer comprising the diamond fragments.

6. The long-reach drilling machine as defined in claim 3, wherein at least some rollers are movable with respect to each other between an engaged position in which the at least some rollers are displaced towards the tube channel to grasp the core tube and allow its retrieval from and insertion into the drill string, and a disengaged position in which the at least some rollers are displaced away from the tube channel to release the core tube.

7. The long-reach drilling machine as defined in claim 1, wherein the frame is attached to the drill head.

8. The A long-reach drilling machine as defined in claim 1, wherein the frame is pivotally attached to one of the drill head, the drill base and the mast such that it is pivotable between an operative position in which it is pivoted towards a path of the core tube incoming or outgoing with respect to the drill string such that the core tube can engage the tube channel, and an inoperative position in which it is pivoted away from the path of the core tube incoming our outgoing with respect to the drill string such that the core tube cannot engage the tube channel.

9. The long-reach drilling machine as defined in claim 1, wherein the borehole core tube displacer comprises at least one of a winch and a water pump.

10. A method of displacing a core tube with respect to a drill string of a long-reach drilling machine as defined in claim 1, comprising:

engaging the core tube with the tube prehension device of the external core tube displacer; and activating the prehension device of the external core tube displacer with the actuator to displace the core tube with respect to the drill string beyond its second positon.

11. The method as defined in claim 10, wherein the step of activating the prehension device to displace the core tube with respect to the drill string beyond its second position is accomplished in a selected one of two directions for respectively retrieving the core tube from the drill string when it is at its second position, or for inserting the core tube into the drill string to position it at its second position.

12. The method as defined in claim 11, wherein the prehension device includes rollers defining a tube channel therebetween, the step of engaging the core tube with the tube prehension device comprising engaging the core tube in the core tube channel, and the step of activating the prehension device with the actuator comprising the actuator acting on at least some of the rollers to rotate them.

13. The method as defined in claim 12, wherein at least some rollers are movable with respect to each other between an engaged position in which the at least some rollers are displaced towards the tube channel to grasp the core tube and allow its retrieval from and insertion into the drill string, and a disengaged position in which the at least some rollers are displaced away from the channel to release the core tube, the step of engaging the core tube with the tube prehension device comprising displacing the at least some rollers towards the tube channel.

14. The method as defined in claim 10, wherein the frame is pivotally attached to one of the drill head, the drill base and the mast such that it is pivotable between an operative position in which it is pivoted towards a path of the core tube incoming or outgoing with respect to the drill string such that the core tube can engage the tube channel, and an inoperative position in which it is pivoted away from the path of the core tube incoming our outgoing with respect to the drill string such that the core tube cannot engage the tube channel, the step of engaging the core tube with the tube prehension device further comprising pivoting the frame towards its operative position.

15. An external core tube displacer for use with a long-reach drilling machine for exploration drilling and core sample collecting of the type comprising a drill string having a first end equipped with a drill bit and a second end opposite the first end, and a core tube movable within the drill string between a first position at the drill string first end and a second position at the drill string second end with a borehole core tube displacer, the external core tube displacer comprising a frame for fixed attachment relative to the drill string, a tube prehension device mounted to the frame and capable of traction on the core tube, and an actuator mounted to the frame and selectively actionable to activate the tube prehension device for allowing the core tube to be displaced relative to the drill string beyond its second position, wherein the tube prehension device and the actuator allow movement of the core tube in two different directions relative to the frame for retrieving the core tube from the drill string and for inserting the core tube into the drill string, and wherein the prehension device includes rollers defining a tube channel therebetween for engagement by the core tube, with the actuator acting on at least some of the rollers to rotate them.

16. The external core tube displacer as defined in claim 15, wherein the rollers have outer surfaces provided with diamond fragments for providing a high friction coefficient between the outer surfaces and the core tube.

17. The external core tube displacer as defined in claim 16, wherein the rollers are coated with a friction layer comprising the diamond fragments.

18. The external core tube displacer as defined in claim 15, wherein at least some rollers are movable with respect to each other between an engaged position in which the at least some rollers are displaced towards the tube channel for grasping the core tube and allowing its retrieval from and insertion into the drill string, and a disengaged position in which the at least some rollers are displaced away from the channel for releasing the core tube.

* * * * *